US008578644B1

(12) United States Patent
Oquin et al.

(10) Patent No.: US 8,578,644 B1
(45) Date of Patent: Nov. 12, 2013

(54) LIGHT AND ACCESSORY MOUNT FOR A WEAPON SYSTEM

(75) Inventors: Terry B. Oquin, Nashville, TN (US); Erik L. Partridge, Spring Hill, TN (US); Benjamin H. Marsico, Lexington, KY (US); Christopher T. Ford, Lexington, KY (US); Kurtis J. Oetken, Lexington, KY (US)

(73) Assignee: Military Systems Group, Nashville, TN (US)

( * ) Notice: Subject to any disclaimer, the term of this patent is extended or adjusted under 35 U.S.C. 154(b) by 16 days.

(21) Appl. No.: 13/472,363

(22) Filed: May 15, 2012

Related U.S. Application Data

(60) Provisional application No. 61/518,929, filed on May 16, 2011.

(51) Int. Cl.
*F41A 15/00* (2006.01)

(52) U.S. Cl.
USPC ..... 42/90; 42/124; 42/71.01; 89/41.17; 89/41.19; 89/37.01; 89/37.03; 89/37.04

(58) Field of Classification Search
USPC ..... 42/90, 124, 71.01; 89/37.01, 89/37.03–37.04, 41.17, 41.19
See application file for complete search history.

(56) References Cited

U.S. PATENT DOCUMENTS

| | | | | |
|---|---|---|---|---|
| 7,520,083 | B2 | 4/2009 | Dextraze | |
| 7,669,359 | B2 * | 3/2010 | Kim | 42/124 |
| 7,676,975 | B2 * | 3/2010 | Phillips et al. | 42/72 |
| 7,823,316 | B2 | 11/2010 | Storch et al. | |
| 7,870,689 | B2 | 1/2011 | Dextraze | |
| 8,117,781 | B2 * | 2/2012 | Dextraze | 42/124 |
| 8,141,290 | B2 * | 3/2012 | LaFrance et al. | 42/90 |
| 8,191,300 | B2 * | 6/2012 | Daniel | 42/71.01 |
| 2006/0277810 | A1 * | 12/2006 | Leitner-Wise | 42/75.03 |
| 2007/0051235 | A1 * | 3/2007 | Hawkes et al. | 89/37.04 |
| 2010/0154280 | A1 * | 6/2010 | LaFrance et al. | 42/124 |
| 2010/0218411 | A1 * | 9/2010 | Keng | 42/94 |
| 2010/0269392 | A1 * | 10/2010 | Swan | 42/71.01 |
| 2011/0061281 | A1 * | 3/2011 | Kapusta et al. | 42/71.01 |
| 2011/0239513 | A1 * | 10/2011 | Sandman | 42/90 |
| 2012/0042557 | A1 * | 2/2012 | Gomez et al. | 42/90 |
| 2012/0102805 | A1 * | 5/2012 | Buxton | 42/90 |
| 2012/0159831 | A1 * | 6/2012 | LaFrance et al. | 42/90 |

OTHER PUBLICATIONS

Information provided to the Application prior to the filing of the above-captioned application. Such information is included in the accompanying letter.

* cited by examiner

*Primary Examiner* — Michelle Clement
(74) *Attorney, Agent, or Firm* — Waddey & Patterson, P.C.; Ryan D. Levy

(57) ABSTRACT

A light and accessory mount having a mounting bracket for attaching to a weapon mount, the mounting bracket having a proximal side and a distal side, the proximal side of the mounting bracket having one or more mounting holes for connecting the mounting bracket to the weapon mount with mounting fasteners and one or more lugs to engage bosses on the weapon mount; the distal side of the mounting bracket having one or more attachment holes and one of more bosses for attaching a channel assembly to the mounting bracket; the channel assembly including a proximal end and a distal end, the proximal end having one or more attachment points for attaching the channel assembly to the mounting bracket with one or more attachment fasteners and one or more lugs to engage bosses on the distal end of the mounting bracket; and the distal end of the channel assembly having one or more rails for attaching devices.

30 Claims, 9 Drawing Sheets

LIGHT AND ACCESSORY MOUNT FOR A WEAPON SYSTEM

CROSS-REFERENCES TO RELATED APPLICATIONS

This application claims benefit of the following patent application which is hereby incorporated by reference: U.S. Provisional Patent Application Ser. No. 61/518,929 filed May 16, 2011, entitled "Weapon Light and Accessory Mounting Bracket."

BACKGROUND OF THE INVENTION

The present invention relates to a light and accessory mount for a weapon system that may include, but is not limited to, the M2 .50 cal. machine gun, the Mk19 40 mm grenade launcher, the M240 family of 7.62 mm and M249 family of 5.56 mm machine guns in typical weapon mounts such as the Mk93 family of weapon mounts. In optional embodiments of the invention, the light and accessory mount may allow for the attachment of a wide variety of illuminating, optical, and sighting devices and accessories to various weapon systems. Additionally, optional embodiments of the light and accessory mount allow for both the removal and attachment of a weapon to a weapon mount without requiring the removal of the light and accessory mount.

In modern warfare the ability to illuminate, designate, visualize and/or optically magnify and track a target is extremely advantageous and can sometimes mean the difference between winning and losing an engagement. For today's military, it is also very important to be able to quickly differentiate a non-combatant from a potentially hostile attacker. Additionally, there is also a need to use non-lethal means of disabling and/or disorienting hostile attackers by temporarily blinding the attackers with intense light. Modern light and heavy weapon mounts and mounting systems often include designs encompassing defensive armor shields and armor packages on crew-served weapon stations that can protect the gunner from incoming fire. However, the use of such defensive armor can result in difficulties in attempting to integrate weapon lights, optics and sighting devices and accessories to the weapon system.

Furthermore, with some of today's illumination devices for weapon systems weighing multiple pounds, attachment to the weapon itself can become problematic. Also, as the operation of crew-served weapons requires significant concentration and focus in being able to accurately engage targets, lights and sighting accessories must be attached to the weapon system so as to be aligned to illuminate, designate, visualize, magnify or otherwise track the target.

As such, what is desired is a light and accessory mount for a weapon system that allows for the attachment of lights, optics, and other accessories to the weapon system which is durable but yet is simple and easy to install and remove.

BRIEF SUMMARY OF THE INVENTION

An optional aspect of the light and accessory mount includes a two-piece design of a mounting bracket and a channel assembly. The mounting bracket may attach to the weapon mount, with one end of the mounting bracket having mounting holes for connecting to the weapon mount and with the other end having at least one hole for attaching a channel assembly to the mounting bracket. The channel assembly can include at least one channel assembly attachment hole for attaching the channel assembly to the mounting bracket with the other end of the channel assembly having one or more rails for attaching lights and accessories.

An additional optional aspect of the light and accessory mount may include a mounting bracket having one or more fastening lugs for engaging one or more bosses on the weapon mount.

In yet a further optional aspect of the light and accessory mount, the mount may include apertures in the mounting bracket for engaging mounting holes on the proximal side of the mounting bracket in connecting the mounting bracket to a weapon mount.

In another optional aspect of the light and accessory mount, the mount may include one or more bosses on the distal end of the mounting bracket for engaging lugs on the channel assembly.

An additional optional aspect of the light and accessory mount may include a channel assembly having an end with at least one channel assembly attachment hole for attaching the channel assembly to the mounting bracket and also an end with one or more rails for attaching weapon lights and accessories. The end of the channel assembly for attaching to the mounting bracket may also include one or more lugs for engaging bosses on the mounting bracket.

An optional aspect of the light and accessory mount may include a mounting bracket formed, forged or machined from a heat-treatable stainless steel, such as 17-4 PH or from carbon steels or alloy steels such as 4000 series steels.

A yet further optional aspect of the light and accessory mount may include a channel assembly formed or extruded from 5000, 6000 or 7000 series aluminum, including without limitation such tempered aluminum alloys as 6061-T6 7075-T651 or 7050-T7651. Optionally, titanium and magnesium alloys could also be used to form the channel assembly.

An additional optional aspect of the light and accessory mount may include a channel assembly having an elongated body with a curved cross-section with an open top and an interior area for a weapon.

An optional aspect of the light and accessory mount may also include the elongated body of a channel assembly being formed from aluminum, magnesium, titanium or steel with the lugs on the channel assembly being formed from stainless or alloy steel.

A further optional aspect of the light and accessory mount may include the light and accessory mount capable of being attached to various models of Mk93 weapon mounts.

A further optional aspect of the light and accessory mount may include the use of bolts and/or pins for the mounting fasteners and attachment fasteners in securing the light and accessory mount to a weapon mount.

A yet further optional aspect of the light and accessory mount may include a mounting bracket for attaching to a weapon mount, such as a Mk93 family weapon mount with the mounting bracket having a proximal side and a distal side. The proximal end of the mounting bracket may include one or more mounting holes and one or more lugs for mounting to the Mk93 family weapon mount, the distal end of the mounting bracket having one or more attachment holes for attaching the channel assembly to the mounting bracket. The channel assembly may have an elongated body with a curved cross-sectional shape, an open top and an interior area for a weapon. The end of the channel assembly for attaching to the mounting bracket may include one or more channel assembly attachment points for engaging one or more attachment holes on the distal side of the mounting bracket as well as one or more lugs for engaging one or more bosses on the mounting bracket. The other end of the channel assembly may have one or more rails for attaching accessories.

A further optional aspect of the light and accessory mount may include a method of mounting the light and accessory mount to a weapon mount wherein the weapon is removable without requiring the removal of the light and accessory mount.

Another optional aspect of the light and accessory mount may include a method of mounting the light and accessory mount to a weapon mount wherein the channel assembly of the light and accessory mount can be removed from the weapon system or attached to the weapon system without requiring removal of the weapon from the weapon system.

Aside from the structural and procedural arrangement set forth above, the invention could include a number of other arrangements, such as those explained hereinafter. It is to be understood, that both the foregoing description and the following description are exemplary.

The accompanying drawings are incorporated in and constitute a part of the specification. The drawings illustrate optional embodiments of the invention and together with the description serve to explain some principles of the invention.

BRIEF DESCRIPTION OF THE DRAWINGS

Reference will now be made in detail to optional embodiments of the invention, examples of which are illustrated in the accompanying drawings. Whenever possible, the same reference numbers are used in the drawing and in the description referring to the same or like part.

DETAILED DESCRIPTION

Throughout the specification and claims, the following terms take at least the meanings explicitly associated herein, unless the context dictates otherwise. The meanings identified below do not necessarily limit the terms, but merely provide illustrative examples for the terms. The meaning of "a", "an", and "the" may include plural references, and the meaning of "in" may include "in" and "on". The phrase "in an embodiment" as used herein does not necessarily refer to the same embodiment, although it may.

Referring generally to the included figures, there are multiple illustrations of an optional embodiment of a light and accessory mount. Briefly stated, a light and accessory mount in accordance with the present disclosure provides a user with a way to mount lights and accessories to a crew-served weapon system including, but not limited to the M2 .50 cal. machine gun and associated Mk93 family of weapon mounts.

Figure 1:
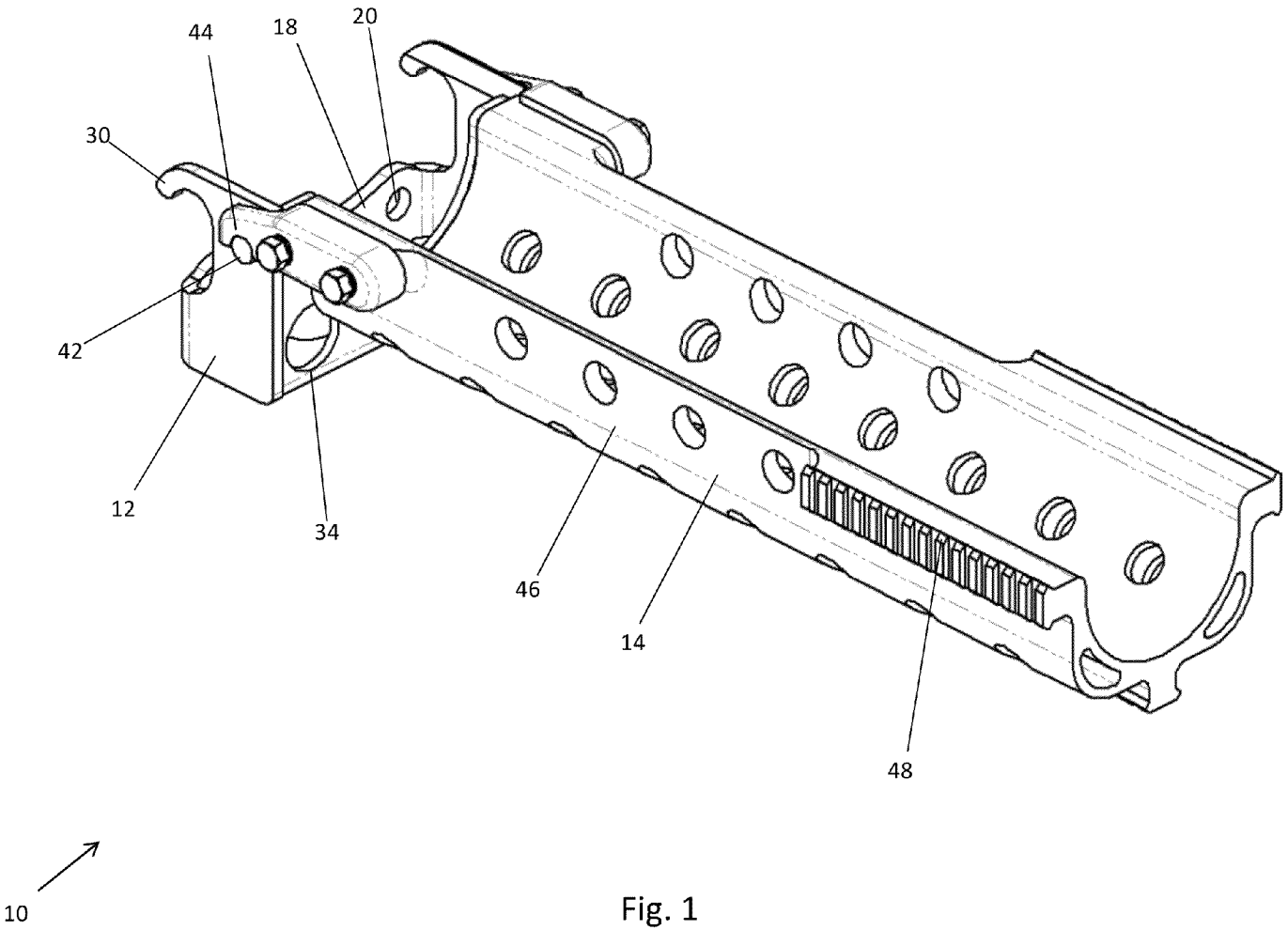
FIG. 1 is an isometric view of an optional embodiment of the light and accessory mount with the channel assembly engaging the mounting bracket.
Figure 2:
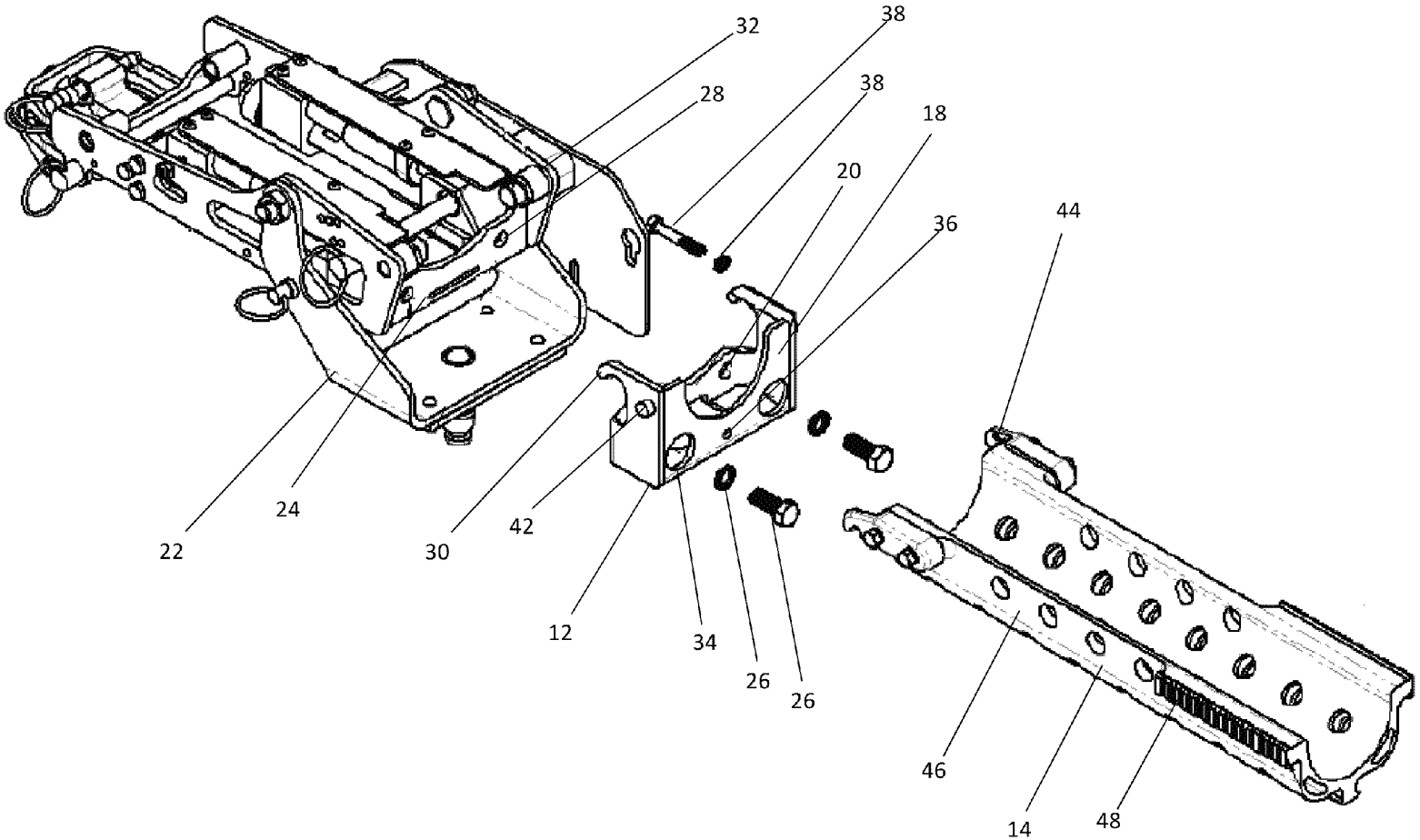
FIG. 2 is an isometric exploded view showing a typical weapon mount with an optional embodiment of the light and accessory mount including both the mounting bracket and channel assembly.
Figure 3:
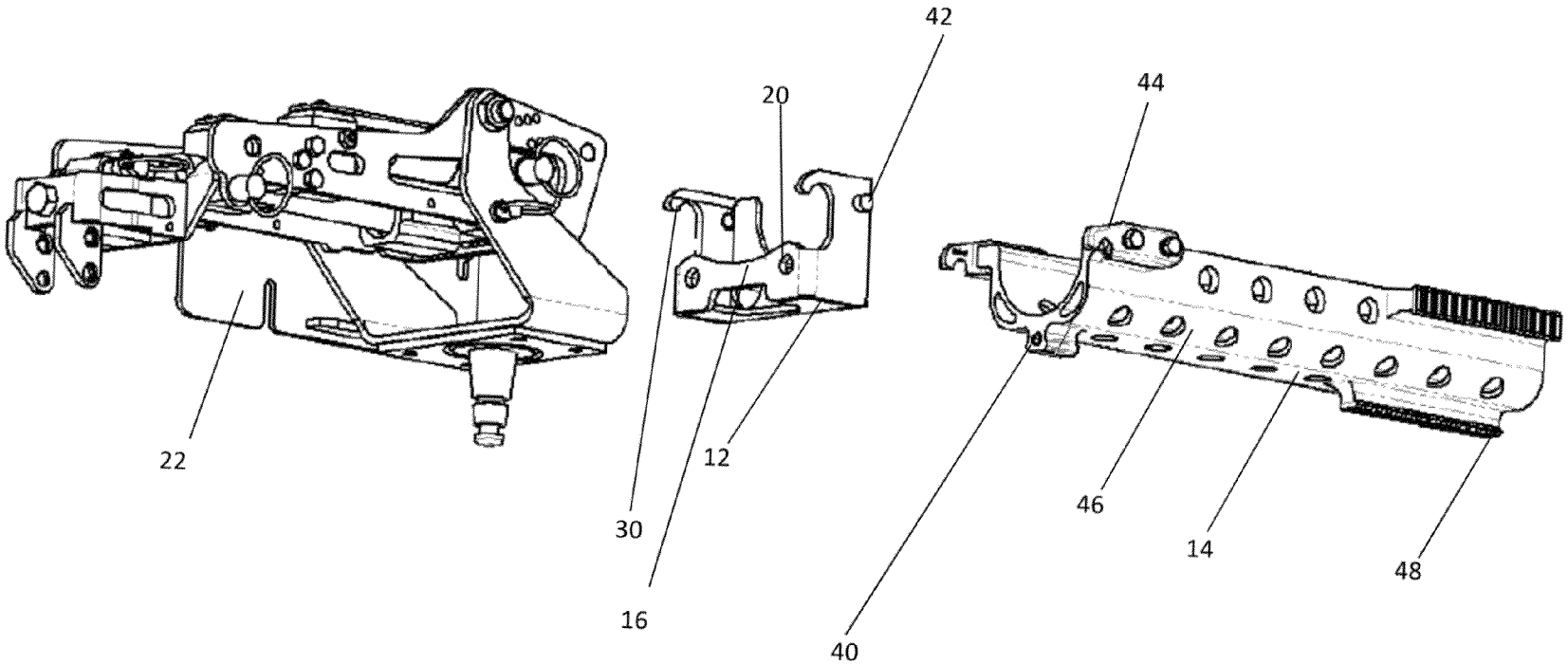
FIG. 3 is an additional exploded view of a typical weapon mount with an optional embodiment of the light and accessory mount with the mounting bracket and channel assembly.
Figure 4:
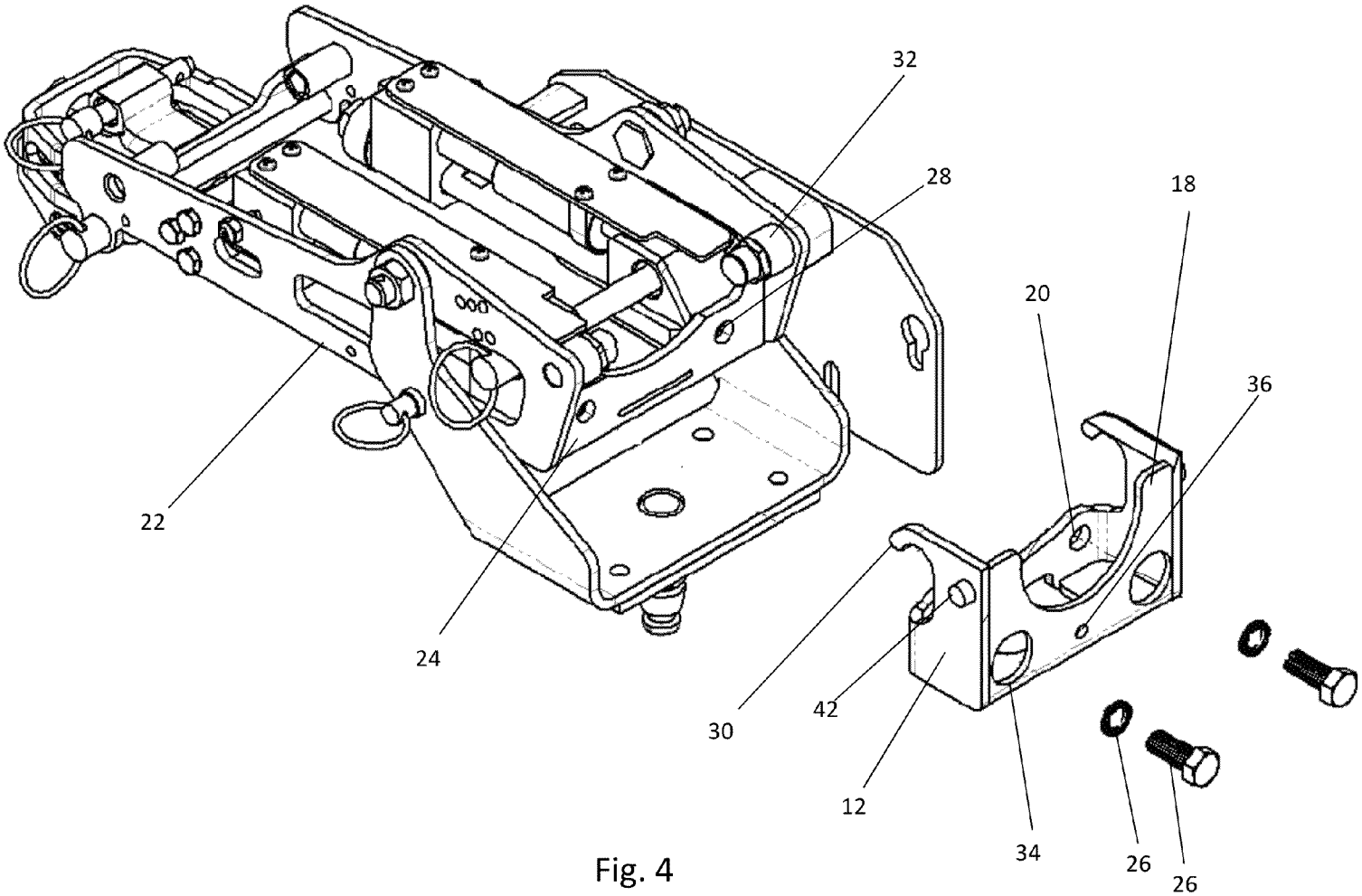
FIG. 4 is an isometric view showing a typical weapon mount with an optional embodiment of the light and accessory mount's mounting bracket with mounting fasteners.
Figure 5:
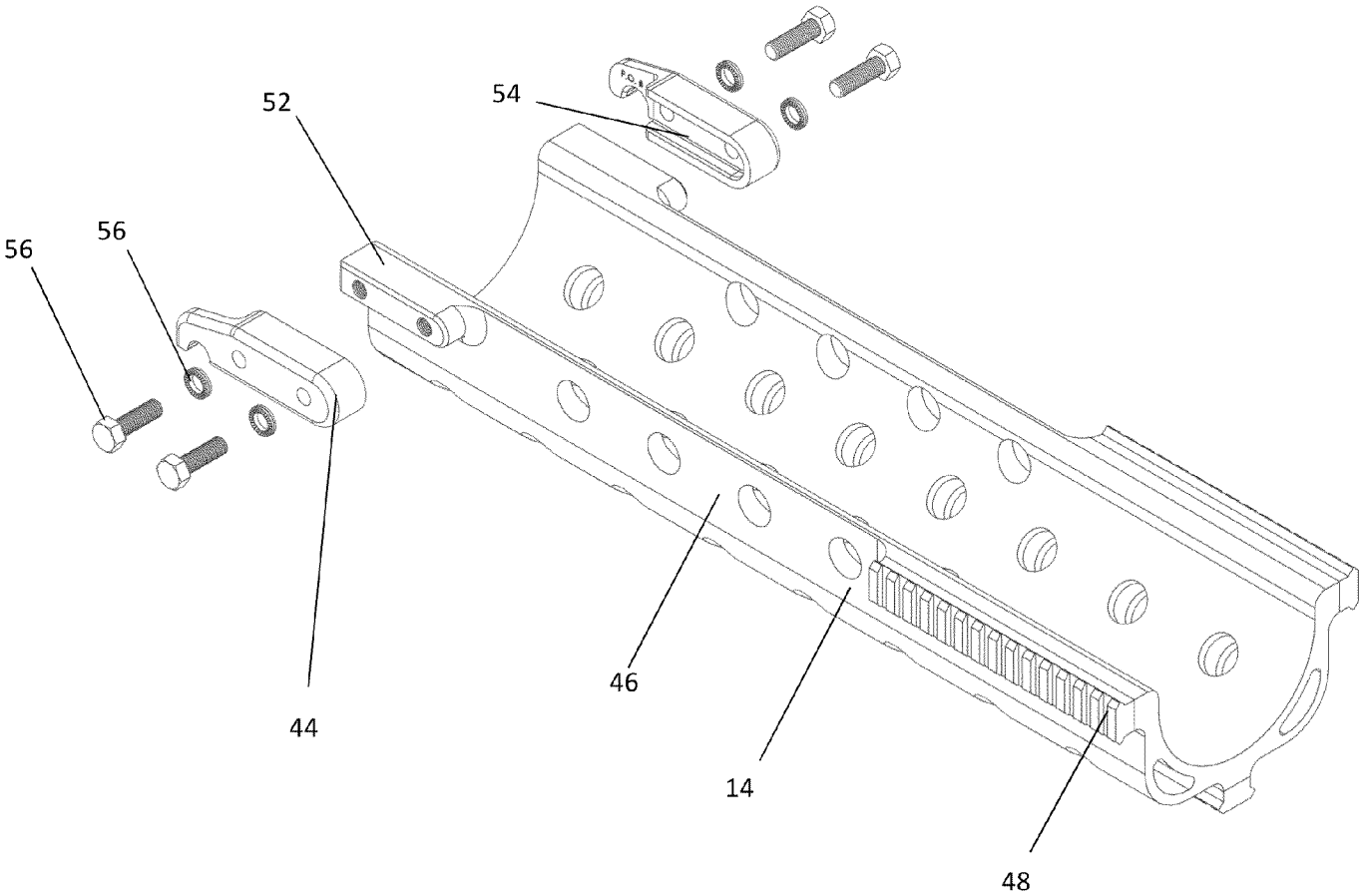
FIG. 5 is a view showing an optional embodiment of the relationship of the channel assembly lugs to the channel assembly.
Figure 6:
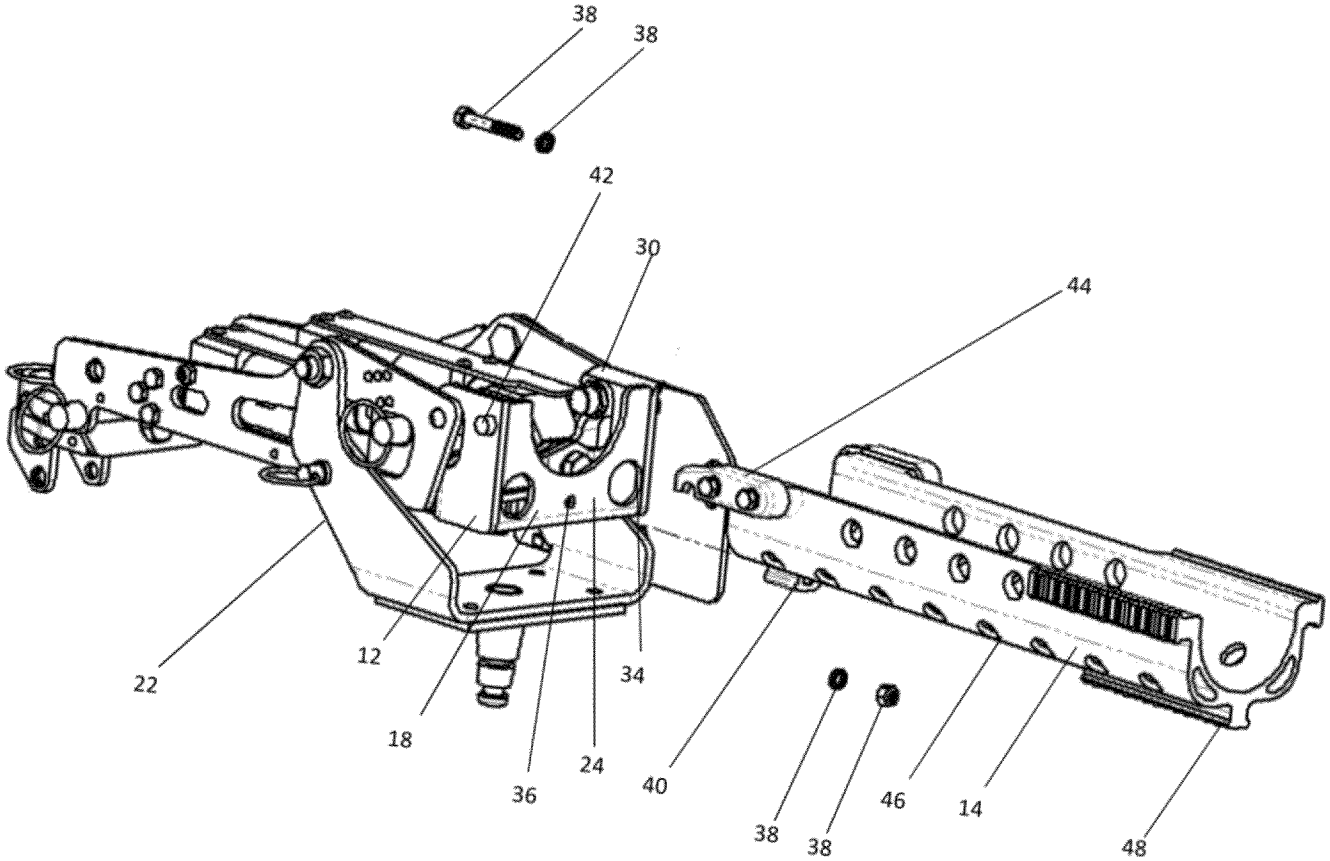
FIG. 6 is a view showing an optional embodiment of the light and accessory mount with its mounting bracket attached to a typical weapon mount and the channel assembly yet to be attached.
Figure 7:
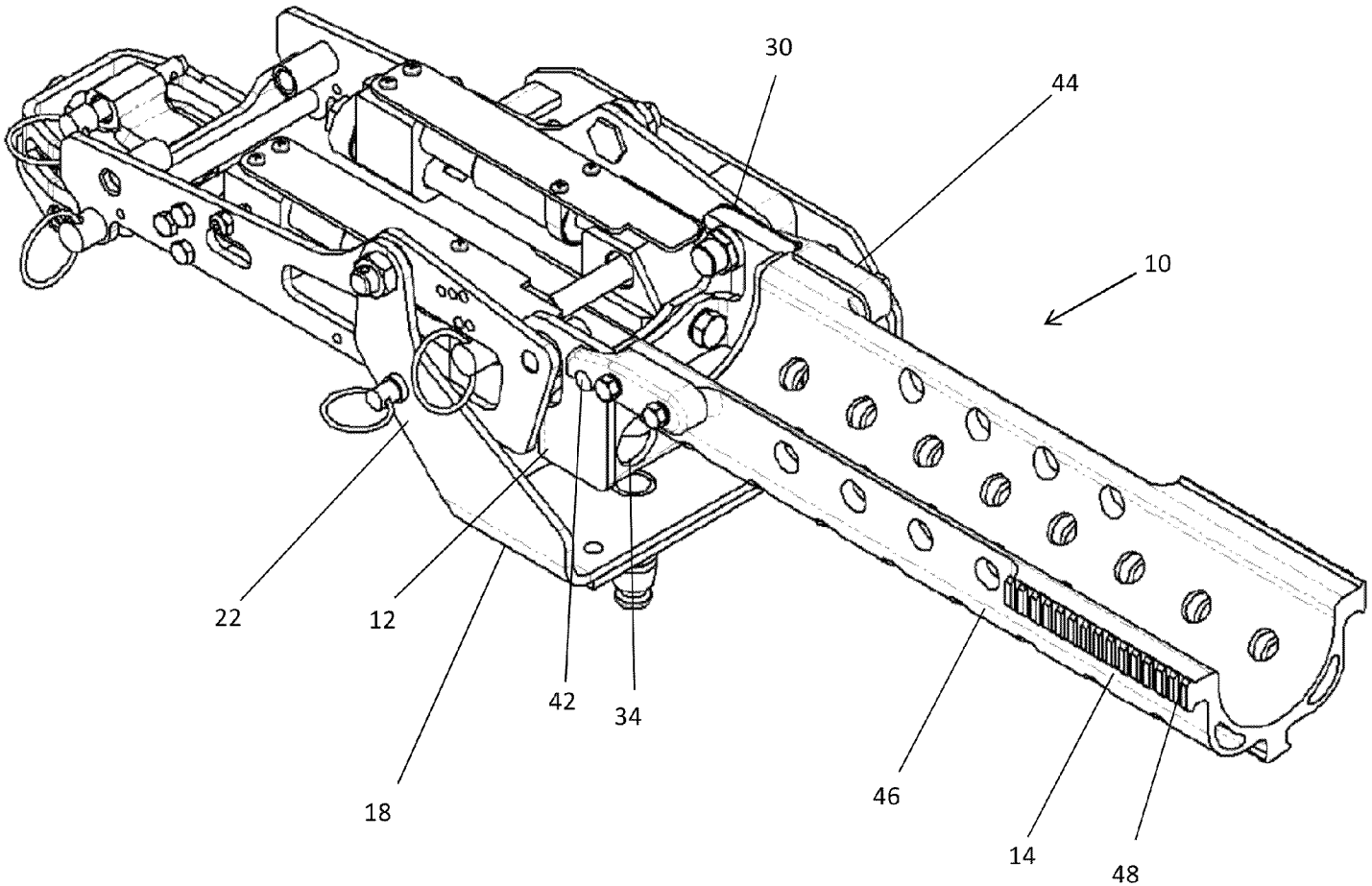
FIG. 7 is an isometric view showing an optional embodiment of the light and accessory mount installed on a typical weapon mount.
Figure 8:
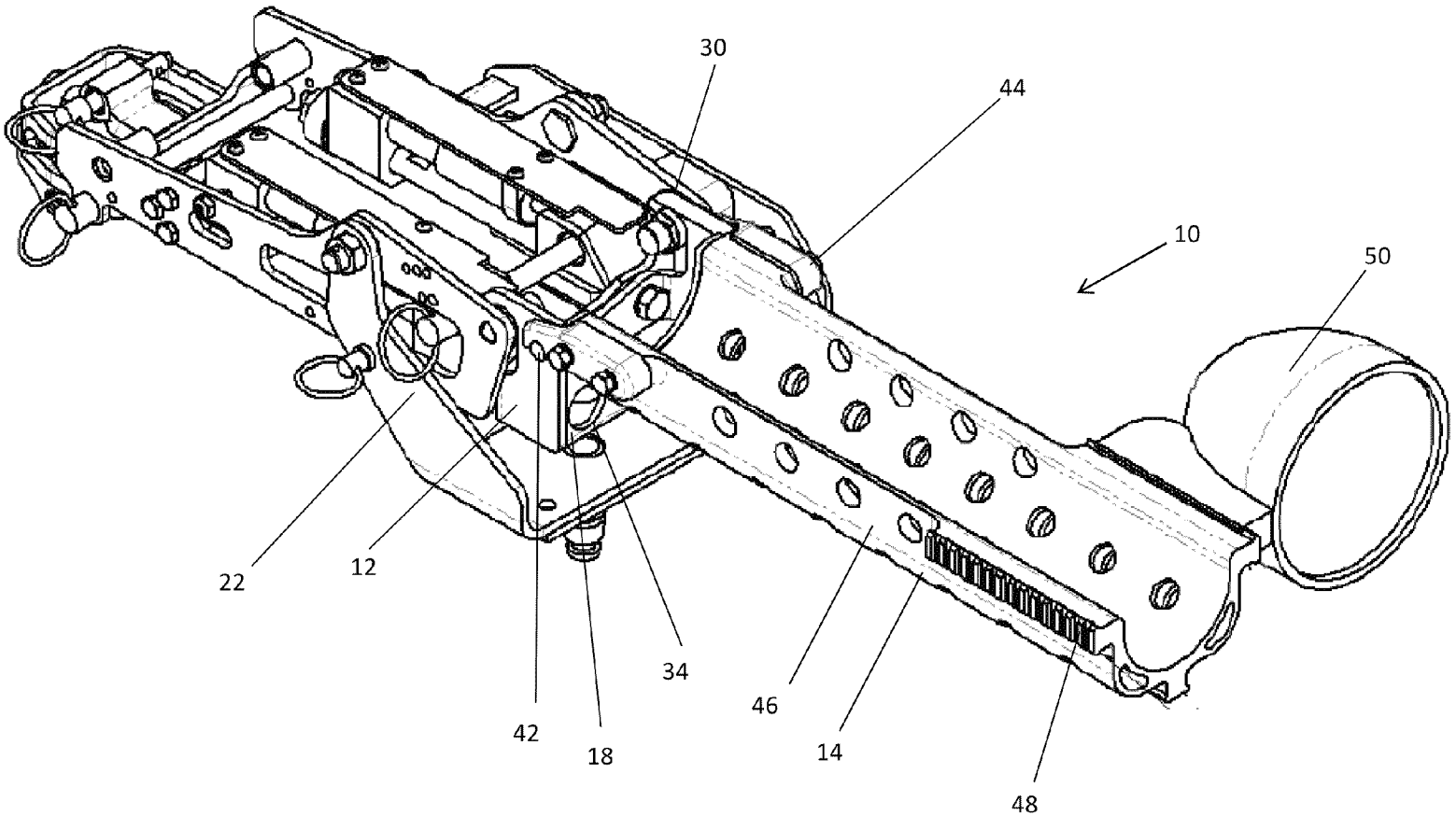
FIG. 8 is an isometric view showing an optional embodiment of the light and accessory mount installed on a typical weapon mount with a light attached to a rail of the channel assembly of the light and accessory mount.
Figure 9:
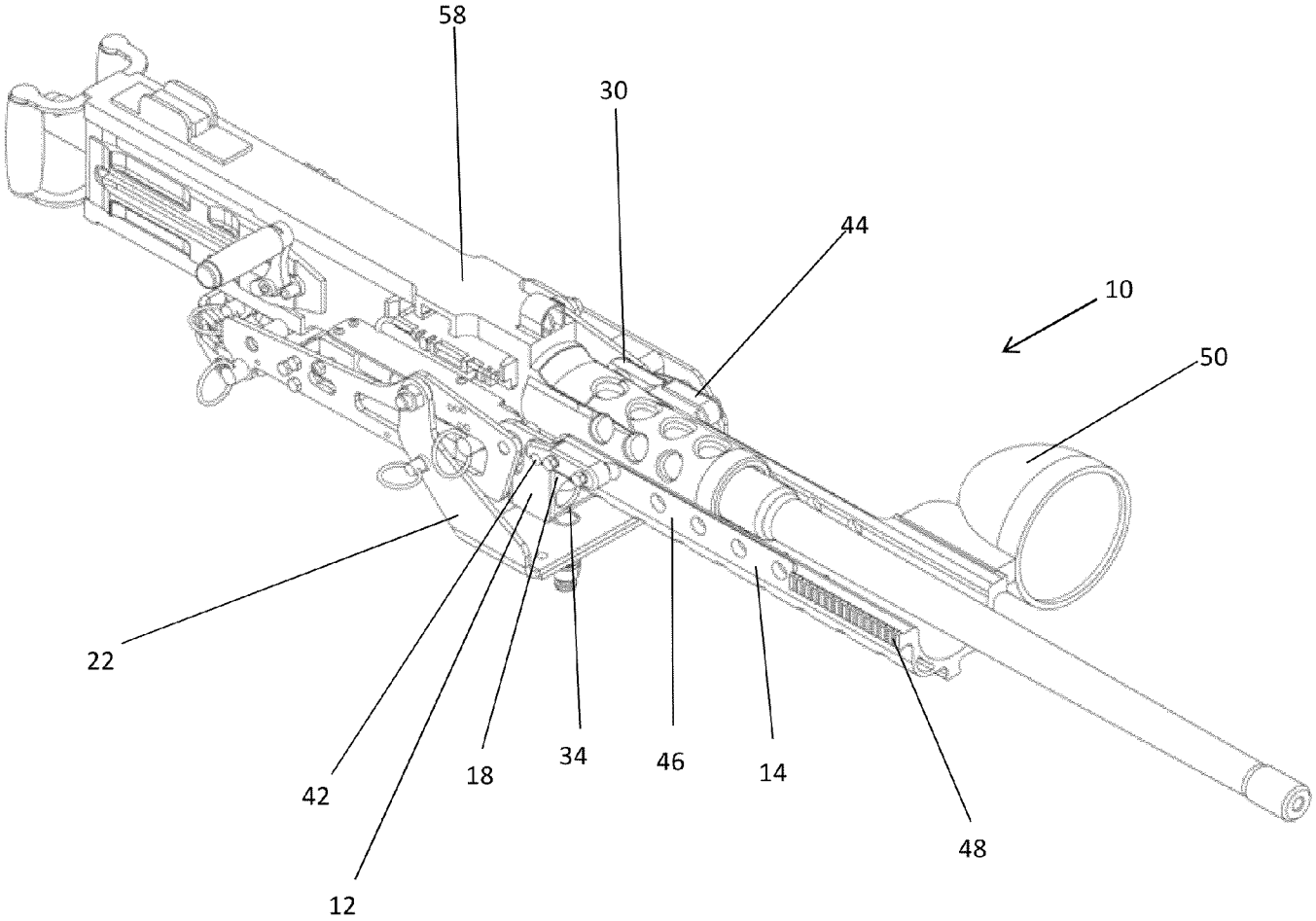
FIG. 9 is a view showing an optional embodiment of the light and accessory mount attached to a typical weapon mount with a weapon attached to the weapon mount.

Referring to FIGS. 1-8, the light and accessory mount is designated by numeral 10 and generally includes two main components. Mounting bracket 12 and channel assembly 14 are the two main components of light and accessory mount 10 in mounting to a weapon mount and providing the necessary hardware to attach lights and accessories to a weapon system.

The optional embodiment of mounting bracket 12 includes proximal side 16, distal side 18, and mounting holes 20. Mounting holes 20 may be used in attaching mounting bracket 12 to weapon mount 22 in seating proximal side 16 of mounting bracket 12 in contact with distal side 24 of weapon mount 22. Mounting fasteners 26 may be inserted within mounting holes 20 with fasteners 26 engaging bolt holes 28 of weapon mount 22. In optional embodiments, lesser or greater numbers of mounting holes 20 on mounting bracket 12 may be included as well as lesser or greater numbers of bolt holes 28 on weapon mount 22. Furthermore, as used herein, fasteners 26 can include any of the associated hardware to fasten mounting bracket 12 to weapon mount 22 via mounting holes 20. Thus, fasteners can include bolts, washers, including Nord-Lock® washers, and/or pins or other similar devices.

The optional embodiment of mounting bracket 12 of light and accessory mount 10 is designed to correspond to weapon mounts which by example may include the Mk93 family of weapon mounts, though the term "weapon mount" is not limited to the Mk93 family of weapon mounts. Further, as used herein, "weapon mount" refers to the hardware to which a weapon is mounted which retains and supports the weapon and allows it to traverse a field of fire. Thus, in discussing the light and accessory mount, one should understand that the light and accessory mount connects to the weapon mount as opposed to the actual weapon. Thus as previously mentioned, mounting holes 20 may be sized to correspond to bolt holes 28 on weapon mount 22.

Thus in optional embodiments, light and accessory mount 10 for a Mk93 family weapon mount, the original bolts may be removed from bolt holes 28 within weapon mount 22 and subsequently mounting bracket 12 may be placed in a position so that mounting holes 20 of mounting bracket 12 generally align with bolt holes 28 of weapon system 22. Subsequently, mounting fasteners 26 may be inserted to fasten mounting bracket 12 to weapon mount 22.

Additionally mounting bracket 12 may also include lugs 30 which can correspond to bosses 32 on weapon mount 22. As used herein, the term "lug" refers to a projection or extension on any of the various components on the light and accessory mount which assists in holding or supporting a component or components of the light and accessory mount. Furthermore, the term "boss" may refer to a projection, post, knob, or bolt end which may engage a lug of the light and accessory mount.

As such, lugs 30 of mounting bracket 12 of light and accessory mount 10 are designed to correspond to bosses 32 located on weapon mount 22. Advantageously, bosses 32 are a standard feature of the Mk93 family of weapon mounts and thus hardware is not required to be changed on the weapon mount to create these bosses for connecting with the mounting bracket of optional embodiments of the light and accessory mount. Yet furthermore, when an optional embodiment of the light and accessory mount is used with a Mk93 family weapon mount as weapon mount 22, likely the only addition or change that is made is to the Mk93 family weapon mount is a substitution of the original bolts that fit within bolt holes 28 with new mounting fasteners so as to accommodate mounting bracket 12. This may also include the use of Nord-Lock® washers as part of the mounting fasteners to better secure the mounting bracket to the weapon mount.

Mounting bracket 12 may also include apertures 34 to assist in allowing a user to better access mounting fasteners 26 in connecting mounting bracket 12 to weapon mount 22. The apertures may take on various shapes and sizes and thus are only defined as openings or open area which can aid in accessing mounting fasteners for connecting a mounting bracket to a weapon mount.

Mounting bracket 12 of light and accessory mount 10 may also include one or more attachment holes 36 which can be used to secure channel assembly 14 to mounting bracket 12 with attachment fastener(s) 38. The one or more attachment holes 36 may include either threaded or non-threaded holes. In optional embodiments of light and accessory mount 10, one or more attachment fasteners may be utilized to attach channel assembly 14 to mounting bracket 12. In optional embodiments there may be additional attachment holes 36 on distal side 18 of mounting bracket 12 which may correspond to various attachment points 40 on channel assembly 14. As illustrated in the figures, channel assembly 14 includes one attachment point 40 which corresponds to attachment hole 36 on distal side 18 of mounting bracket 12 though as stated in other optional arrangements lesser or greater numbers of attachment points and attachment holes may be utilized.

Optional embodiments of light and accessory mount 10 may include bracket bosses 42. In the optional embodiment as illustrated in the accompanying figures, bosses 42 may extend from the sides of mounting bracket 12 to engage channel assembly lugs 44 in attaching channel assembly 14 to mounting bracket 12 of light and accessory mount 10. In some optional embodiments, pins and openings could be utilized rather than bosses and lugs or alternatively bosses 42 could be located in different positions corresponding to a different position for the lugs on channel assembly 14.

Referring now to channel assembly 14, channel assembly 14 generally includes lugs 44, attachment point 40, elongated body 46, and rails 48. As is illustrated in the accompanying figures, channel assembly lugs 44 can engage bosses 42 of mounting bracket 12 in attaching channel assembly 14 to mounting bracket 12. When properly seated, attachment point 40 aligns with attachment hole 36 so that attachment fastener 38 can link mounting bracket 12 to channel assembly 14. As used and described herein, the proximal end of channel assembly 14 is the end with attachment point 40 and channel assembly lugs 44 whereas the distal end of channel assembly 14 is the end with rails or otherwise understood to be positioned closer to the muzzle of an associated weapon.

Channel assembly lugs 44 may attach to distal side 18 of mounting bracket 20 in a variety of ways including through the use of bolts. In some optional embodiments, channel assembly lugs 44 are a separate component that is attached to channel assembly 14 as lugs 44 may be formed from different material than the rest of channel assembly 14. Channel assembly lugs 44 may be machined or formed in a prescribed shape or have prescribed cuts in them which mate or connect with machined or formed features on elongated body 14. Such machined or formed features in lugs 44 and elongated body 14 being designed to enhance the load bearing capability of the mounting interface between lugs 44 and elongated body 14. Yet in further optional embodiments, channel assembly lugs 44 may be integrated to channel assembly 14 through welds or other bonding mechanisms including the uses of adhesives or the like. Alternatively, channel assembly lugs may be molded, forged, milled, or extruded with channel assembly 14.

Channel assembly 14 may also include elongated body 46 which may have a generally curved cross-sectional shape on either the exterior surface, interior surface, or both. In describing the shape of elongated body 46 of mounting bracket 12 one can consider such cross-sectional shape as curved, U-shaped, semi-circular or the like. In general, the shape of elongated body 46 can be manufactured in a multitude of configurations as dictated by the size, shape and clearance requirements of the weapon and weapon accessories used in the weapon mount. However, such descriptions are not taken to be limiting as the size and shape of the interior and/or exterior surfaces of channel assembly 14's elongated body 46 may in further optional embodiments be V-shaped or include a variety of flat surfaces when considering the cross-section surfaces of elongated body 46 of channel assembly 14. As such, the optional embodiment of elongated body 46 of channel assembly 14 as provided in the figures should not be taken as limiting but rather as an example to indicate one possible design of elongated body 46.

Additionally, elongated body 46 of channel assembly 14 may include an open top section with the inner surface of elongated body 46 defining an area for components of a weapon. Since an M2 .50 cal. machine gun is often utilized with weapon mounts such as the Mk93 family of weapon mounts, channel assembly 14 with elongated body 46 can advantageously provide enough clearance to components of the weapon, including the heat shield and barrel, so that the weapon can function properly while also allowing for channel assembly 14 to be removed without dismounting the weapon and its associated accessories from the weapon mount.

In the optional embodiment of channel assembly 14 as illustrated, areas of channel assembly 14 may include a double wall design that can provide the benefit of weight savings while providing sufficient rigidity. Yet furthermore, elongated body 46 of channel assembly 14 may include a variety of holes or openings so as to further allow for a decrease in weight while also providing for increased air flow in dissipating heat from the accompanying weapon. The holes and/or apertures within elongated body 46 of channel assembly 14 may take on a variety of shapes and sizes and thus are not limited to a generally circular arrangement as is illustrated in the accompanying figures nor are such holes required. Additionally, in optional embodiments, elongated body 46 could also be of different lengths depending on the weapon 58 or desires by the user.

Channel assembly 14 also provides one or more rails 48 located near the end of elongated body 46 for the mounting of lights and accessories. Such rails may be integrated and form a continuous part of elongated body 46 of channel assembly 14 or alternatively may be bolted, riveted or otherwise fastened onto elongated body 46. In optional embodiments of light and accessory mount 10, rails 48 are extruded with the rest of elongated body 46 of channel assembly 14 and then subsequently milled to provide for an appropriate rail 48 for attaching lights and accessories. In optional embodiments rails 48 may be Picatinny rails complying with the standards for MIL-STD-1913 for such rails and thus may be compatible with a variety of lights and accessories.

As used herein the term "light" can refer to any type of illuminating device as well as a device emitting visible and/or non-visible light with "accessories" referring to a variety of different components including optics and designators for which a user may attach to the rail in operating a machine gun. Furthermore, the term "lights" and "accessories" are not meant to be distinct but rather in many instances accessories can include types of lights and lights can include a variety of different types of accessories. Also, in understanding the light and accessory mount, there may be no lights or accessories included on the rails of the channel assembly while alternatively only lights may be included or alternatively only accessories may be included on the light and accessory mount.

Rather, rails 48 are provided so one may use both lights and accessories, lights only, accessories only, or alternatively, have no attachments on rails 48. In further optional embodiments, the number of rails 48 on elongated body 46 of channel assembly 14 may be lesser or greater and thus the use of three rails as provided in the optional embodiments in the illustrations is only exemplary of a possible orientation and should not to be considered as limiting with respect to the numbers of rails that could be on a light and accessory mount.

A variety of different materials may be utilized in forming the various components of light and accessory mount 10. Mounting bracket 12 may be formed, forged, cast or machined from conventional steels as well as alloy steels such as 4000 series steels or heat-treatable stainless steels such as 17-4PH stainless steel. In optional embodiments, mounting bracket 12 may be formed as a weldment or alternatively forged or machined from a solid piece of material. Channel assembly 14 may also be formed of various materials. Generally elongated body 46 of channel assembly 14 may be formed from aluminum to provide for both a decrease in weight and expense. Such aluminum alloys may include 5000, 6000 or 7000 series aluminum, including without limitation such tempered aluminum alloys as 6061-T6 7075-T651 or 7050-T7651. However, channel assembly 14 can also be formed from steel and further can be a weldment or cast or formed from a magnesium or titanium alloy.

Lugs 44 attached to channel assembly 14 may be formed of carbon steel but may be formed or machined from a heat-treatable alloy or stainless steel which may include 17-4PH. As the lugs and the channel assembly may encounter substantial stress, the use of heat-treatable alloy or stainless steels instead of aluminum may improve the durability of the light and accessory mount. In forming the elongated body of channel assembly, the entire aluminum portion may be extruded to achieve the desired shape and design as well as to increase the strength, durability and ease of manufacture of the channel assembly. This may result in a more uniform wall thickness that may add to the rigidity and durability of the light and accessory mount.

In attaching lugs 44 to channel assembly 14 of the optional embodiment of light and accessory mount 10, lugs 44 may be sized to fit lug fittings 52 on channel assembly 14. Lug fittings 52 may be formed as an integral part of channel assembly 14 similar to how in optional embodiments elongated body 46 and rails 48 may be formed. Lug fasteners 56 may be used to attach lugs 44 to lug fittings 52. Lugs 44 and lug fittings 52 may optionally be designed to transfer loads from the hooks of lugs 44 to channel assembly 14 without placing substantial shear or bending loads on lug fasteners 56. As such, in optional embodiments, the dimensions of inner lug areas 54 may closely matching the outer dimensions of lug fittings 52 which may reduce the amount of shear stress placed upon lug fasteners 56.

Mounting bracket 12 and channel assembly 14 of light and accessory mount 10 can be used with a variety of different weapon systems. Mounting bracket can be sized to fit a variety of weapon mounts 22. For some weapon systems, mounting holes 20 on mounting bracket 12 may be situated differently on proximal side 16 of mounting bracket 12 so as to correspond to differences in different weapon mounts. Also, lugs 30 may be in a different location, have a different design, or be absent in other optional embodiments. In instances where different embodiments of mounting bracket 12 are designed to fit different weapon mounts 22 and thus might not be interchangeable, the same channel design of channel assembly 14 could in optional embodiments fit one or more different mounting brackets 12. As channel assembly 14 attaches to distal side 18 of mounting bracket 12, optional embodiments of mounting bracket 12 could have different proximal sides 16 for corresponding to different weapon mounts 22 but similar distal sides 18 so one channel assembly 14 could mount to all. Otherwise stated, a user could have different mounting brackets 12 attached to different weapon mounts 22 and rotate channel assemblies 14 among the different mounting brackets 12.

The light and accessory mount as described in the optional embodiments may be created and tested in accordance with MIL-STD-810G and thus has sufficient durability for mounting on a variety of military vehicles. Through such design, the light and accessory mount can support a significant amount of weight on the end of the channel assembly near the rails and can support weapon lights including, by example, the Sure-Fire® HellFighter® with no issues.

Advantageously, a user can remove the entire weapon (designated by numeral 58) from weapon mount 22 which may include an M2 .50 cal. machine gun and its accessories without having to remove light and accessory mount 10 attached to the weapon mount 22. Alternatively, a user can further advantageously remove just channel assembly 14 of light and accessory mount 10 from mounting bracket 12 without having to remove the entire weapon, its barrel or its weapon accessories.

To install light and accessory mount 10 on weapon mount 22 which includes the Mk93 family of weapon mounts, a user can first remove the previously existing bolts from bolt holes 28 in weapon mount 22. A user could then position lugs 30 of mounting bracket 12 over bosses 32 of weapon mount 22 to position mounting bracket 12 in place. Once proximal side 16 of mounting bracket 12 is fully seated against weapon mount 22, the user may then install mounting fasteners 26 to mount mounting bracket 12 to weapon mount 22. A user could then position lugs 44 of the channel assembly 14 of the light and accessory mount 10 over bosses 42 extending from the sides of the mounting bracket 12. With channel assembly 12 seated in place next to distal side 18 of mounting bracket 12, a user may then install attachment fastener 38 through attachment point 40 on the underside of the channel assembly 14 to attachment hole 36 located on mounting bracket 12. The engagement of lugs 44 on channel assembly 14 to bosses 42 of mounting bracket 12 coupled with attachment fastener 38 and related hardware serve to secure channel assembly 14 to mounting bracket 12 provide a durable and secure light and accessory mount 10 for a user. Once installed, a user may attach lights 50 or other accessories to rails 48 located on channel assembly 14. The multitude of perforations or holes along the sides of channel assembly 14, in addition to reducing overall weight, serve to provide mounting points where a user can route and affix wiring associated with a weapon light and accessories.

If a user desires to remove channel assembly 14 with weapon 58 in place all the user must do is remove attachment fastener 38 that spans through attachment hole 36 on mounting bracket 12 and through attachment point 40 on channel assembly 14 and then lift lugs 44 of channel assembly 14 off of bosses 42 of mounting bracket 12.

Through use of the invention in this disclosure, a light and accessory mount is provided that allows for a user to mount lights and other accessories to a weapon system which may include, among other weapons, a M2 .50 cal. machine gun in the Mk93 family of weapon mounts. In other optional embodiments, the light and accessory mount as disclosed herein may be used with a variety of different armor and kits including the Objective Gunner Protection Kit armor shield which may assist in providing better protection to a user of a weapon system. Though the light and accessory mount as described herein has been discussed generally in reference to the Mk93 family of weapon mounts and the M2 .50 cal. machine gun, such description is not limiting its use to only that weapon system and thus the light and accessory mount can be adapted to a variety of different weapon systems as well. For example, through modifications in the size of the device, the light and accessory rail as described herein may also be used with weapon mounts designed specifically for light caliber machine guns, such as the U.S. Marine Corps M35 weapon system for example.

Furthermore, while the Mk93 family of mounts has been used in discussing embodiments of the light and accessory mount, the light and accessory mount can be used with a variety of other weapon mounts and weapons and is not limited in use to the Mk93 family of mounts. Persons of ordinary skill in the art would recognize that the light and accessory mount could be used with other crew-served weapon and other weapon mounts where it may be desirable to have a light and accessory mount attachable to a weapon mount and not the weapon.

Furthermore, sizes of various structural parts and materials used to make the above-mentioned components are illustrative and exemplary only, and persons of ordinary skill in the art would recognize that these sizes and materials can be changed as necessary to produce different results or different desired characteristics. It would become apparent to those skilled in the art that various modifications and variations can be made to the structure and methodology of the present invention. Thus, it should be understood that the invention is not limited to the examples disclosed in the specification. Rather, the present invention is intended to cover modifications and variations.

Thus, although there have been described particular embodiments of the present invention of a new and useful light and accessory mount it is not intended that such references be construed as limitations upon the scope of this invention except as set forth in the following claims.

What is claimed is:

1. A light and accessory mount comprising:

a mounting bracket for attaching to a weapon mount, the mounting bracket having a proximal side and a distal side, the proximal side of the mounting bracket having one or more mounting holes for connecting the mounting bracket to the weapon mount with mounting fasteners;

the distal side of the mounting bracket having one or more attachment holes for attaching a channel assembly to the mounting bracket;

the channel assembly including a proximal end and a distal end, the proximal end having one or more attachment points for attaching the channel assembly to the mounting bracket with one or more attachment fasteners and the proximal end having one or more fastening lugs for engaging one or more bosses on the weapon mount; and the distal end of the channel assembly having one or more rails for attaching devices.

2. The mount of claim 1 wherein the distal end of the mounting bracket further comprises one or more apertures for inserting mounting fasteners through the one or more mounting holes of the mounting bracket.

3. The mount of claim 1 wherein the sides of the mounting bracket comprise one or more bosses.

4. The mount of claim 3 wherein the channel assembly further comprises one or more lugs for engaging the bosses on the mounting bracket.

5. The mount of claim 1 wherein the mounting bracket comprises carbon steel.

6. The mount of claim 1 wherein the mounting bracket comprises stainless steel.

7. The mount of claim 1 wherein the channel assembly comprises aluminum.

8. The mount of claim 4 wherein the channel assembly lugs comprise stainless steel and the channel assembly comprises aluminum.

9. The mount of claim 7 wherein the channel assembly comprises an aluminum extrusion.

10. The mount of claim 1 wherein the channel assembly comprises material chosen from magnesium alloys and titanium alloys.

11. The mount of claim 1 wherein the mount is attachable to a Mk93 family weapon mount.

12. The mount of claim 1 wherein the mount is attachable to a weapon mount capable of retaining a light or heavy caliber machine gun or grenade launcher.

13. The mount of claim 1 wherein the mounting fastener comprises pins.

14. The mount of claim 1 wherein the mounting fastener comprises bolts.

15. The mount of claim 1 wherein the attachment fastener for attaching the channel assembly to the mounting bracket comprises a bolt.

16. The mount of claim 1 wherein the attachment fastener for attaching the channel assembly to the mounting bracket comprises a pin.

17. A light and accessory mount comprising:

a mounting bracket for attaching to a weapon mount, the mounting bracket having a proximal side, a distal side, and one or more bosses, the proximal side of the mounting bracket having one or more mounting holes for connecting the mounting bracket to the weapon mount with mounting fasteners;

the distal side of the mounting bracket having one or more attachment holes for attaching a channel assembly to the mounting bracket;

the channel assembly including a proximal end, a distal end, and one or more lugs for engaging the bosses on the mounting bracket, the proximal end having one or more attachment points for attaching the channel assembly to the mounting bracket with one or more attachment fasteners; and the distal end of the channel assembly having one or more rails for attaching devices.

18. The mount of claim 17 wherein the proximal end of the mounting bracket further comprises one or more fastening lugs for engaging one or more bosses on the weapon mount.

19. The mount of claim 17 wherein the distal end of the mounting bracket further comprises one or more apertures for inserting mounting fasteners through the one or more mounting holes of the mounting bracket.

20. A light and accessory mount comprising:

a mounting bracket for attaching to a weapon mount, the mounting bracket having a proximal side and a distal side, the proximal side of the mounting bracket having one or more mounting holes for connecting the mounting bracket to the weapon mount with mounting fasteners;

the distal side of the mounting bracket having one or more attachment holes for attaching a channel assembly to the mounting bracket;

the channel assembly including a proximal end and a distal end, the proximal end having one or more attachment points for attaching the channel assembly to the mounting bracket with one or more attachment fasteners;

the channel assembly including one or more lugs, the lugs comprising stainless steel and the channel assembly comprising aluminum; and the distal end of the channel assembly having one or more rails for attaching devices.

21. The mount of claim 20 wherein the proximal end of the mounting bracket further comprises one or more fastening lugs for engaging one or more bosses on the weapon mount.

22. The mount of claim 20 wherein the distal end of the mounting bracket further comprises one or more apertures for inserting mounting fasteners through the one or more mounting holes of the mounting bracket.

23. The mount of claim 20 wherein the sides of the mounting bracket comprise one or more bosses.

24. The mount of claim 20 wherein the channel assembly further comprises an aluminum extrusion.

25. The mount of claim 20 wherein the mount is attachable to a Mk93 family weapon mount.

26. The mount of claim 20 wherein the mount is attachable to a weapon mount capable of retaining a light or heavy caliber machine gun or grenade launcher.

27. A light and accessory mount comprising:

a mounting bracket for fastening to a Mk93 family weapon mount, the mounting bracket having a proximal side, a distal side and bosses for attaching a channel assembly, the proximal side of the mounting bracket having one or more mounting holes and one or more fastening lugs for mounting to the Mk93 family weapon mount;

the distal side of the mounting bracket having one or more attachment holes;

the channel assembly having an elongated body with proximal end and a distal end, the elongated body having a curved cross-sectional surface with an open top and an interior area for part of a weapon;

the proximal end having one or more channel assembly attachment points for engaging the one or more attachment holes on the distal side of the mounting bracket;

the proximal end having one or more lugs for engaging the one or more bosses on the distal end of the mounting bracket; and the distal end of the channel assembly having one or more rails for attaching accessories.

28. The mount of claim 27 wherein the mounting bracket comprises stainless steel.

29. The mount of claim 27 wherein the mounting bracket comprises carbon steel.

30. The mount of claim 27 wherein the elongated body of the channel assembly comprises aluminum and the lugs on the proximal end of the channel assembly comprise stainless steel.

* * * * *